US008826878B2

(12) United States Patent
Robinette et al.

(10) Patent No.: US 8,826,878 B2
(45) Date of Patent: Sep. 9, 2014

(54) MULTIPLE GEAR RATIO STARTER MOTOR

(75) Inventors: Darrell Lee Robinette, Fenton, MI (US); Clyde A. Bulloch, Hartland, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 966 days.

(21) Appl. No.: 12/938,410

(22) Filed: Nov. 3, 2010

(65) Prior Publication Data

US 2012/0103293 A1 May 3, 2012

(51) Int. Cl.

| | |
|---|---|
| ***F02N 15/02*** | (2006.01) |
| ***F02N 11/00*** | (2006.01) |
| ***F02N 11/08*** | (2006.01) |
| ***F02N 15/06*** | (2006.01) |
| ***F02N 15/04*** | (2006.01) |

(52) U.S. Cl.

CPC ..... *F02N 15/046* (2013.01); *F02N 11/0851* (2013.01); *F02N 15/067* (2013.01); *F02N 15/02* (2013.01)

USPC ..... 123/179.25

(58) Field of Classification Search

USPC ..... 123/179.25; 74/7 E, 8; 290/38 R

See application file for complete search history.

(56) References Cited

U.S. PATENT DOCUMENTS

| | | | | | |
|---|---|---|---|---|---|
| 4,841,810 | A * | 6/1989 | Lew | 475/165 |
| 4,862,009 | A * | 8/1989 | King | 290/22 |
| 4,896,550 | A * | 1/1990 | Hikichi et al. | 74/6 |
| 5,279,527 | A * | 1/1994 | Crockett | 475/57 |
| 5,307,701 | A * | 5/1994 | Thonnard | 74/7 E |
| 8,033,191 | B2 * | 10/2011 | Nagahara et al. | 74/7 E |
| 2008/0227592 | A1 | 9/2008 | Steffen et al. | |
| 2009/0007722 | A1 | 1/2009 | Niimi | |

FOREIGN PATENT DOCUMENTS

| | | | | |
|---|---|---|---|---|
| CN | 101323243 | A | 12/2008 | |
| EP | 0582429 | A1 | 2/1994 | |
| JP | 2009092030 | A | 4/2009 | |
| WO | WO2010037200 | * | 4/2010 | F02N 11/00 |

* cited by examiner

*Primary Examiner* — Hieu T Vo
*Assistant Examiner* — Arnold Castro
(74) *Attorney, Agent, or Firm* — Quinn Law Group, PLLC

(57) ABSTRACT

A starter for an internal combustion engine includes a stationary member and an output member adapted for starting the engine. The starter also includes a first planetary gear set and a second planetary gear set. Each of the respective first and second planetary gear sets includes a first, a second, and a third gear member and each of the respective first and second planetary gear sets is operatively connected to the output member. The starter additionally includes a motor operatively connected to the first gear set and to the second gear set for driving the output member. A motor vehicle employing the disclosed starter is also provided.

18 Claims, 3 Drawing Sheets

MULTIPLE GEAR RATIO STARTER MOTOR

TECHNICAL FIELD

The invention relates to a starter motor having multiple gear ratios.

BACKGROUND

In a motor vehicle, the vehicle's engine, such as an internal combustion engine, is typically rotated via a starter to cause the engine to begin powering itself. A typical starter includes a pinion gear that is driven by an electric motor, and that is pushed out for engagement with a ring gear that is attached to the engine's flywheel or flex-plate, in order to start the engine.

In some vehicle applications, a stop-start system is employed, where the engine is automatically stopped or shut off to conserve fuel when vehicle propulsion is not required, and is then automatically re-started by a starter when vehicle drive is again requested. Such a stop-start system may be employed in a conventional vehicle having a single powerplant, or in a hybrid vehicle application that includes both an internal combustion engine and a motor/generator for powering the vehicle.

SUMMARY

A starter for an internal combustion engine includes a stationary member and an output member adapted for starting the engine. The starter also includes a first planetary gear set and a second planetary gear set. Each of the respective first and second planetary gear sets includes a first, a second, and a third gear member. Each of the respective first and second planetary gear sets is operatively connected to the output member. The starter additionally includes a motor operatively connected to the first gear set and to the second gear set for driving the output member.

The third member of the first planetary gear set and the third member of the second planetary gear set may each be operatively connected to the output member. The third gear member of the first planetary gear set may be attached for synchronous rotation with the third gear member of the second planetary gear set.

The starter may also include a first torque-transmitting device and a second torque-transmitting device. The first torque-transmitting device may be engageable to ground one of the second gear member and the third gear member of the first planetary gear set to the stationary member. Additionally, the second torque-transmitting device may be engageable to ground one of the second gear member and third gear member of the second planetary gear set to the stationary member. Any of the first torque-transmitting device and the second torque-transmitting device may be one of a selectively engageable clutch and a selectively engageable brake.

The engagement of the first torque-transmitting device and the disengagement of the second torque-transmitting device may transfer torque from the motor to the output shaft and thereby provide a first engine starting mode. Additionally, the engagement of the second torque-transmitting device and the disengagement of the first torque-transmitting device may transfer torque from the motor to the output shaft and thereby provide a second engine starting mode.

The motor may be operatively connected to the first gear member of the first planetary gear set and to the first gear member of the second planetary gear set. The motor may be operatively connected to the first gear member of the first planetary gear set and to the first gear member of the second planetary gear set via a common shaft.

Each of the first gear member of the first planetary gear set and the first gear member of the second planetary gear set may be a sun gear. Accordingly, the first gear members of the respective first and second gear sets may be characterized by a different tooth count. Additionally, each of the third gear member of the first planetary gear set and the third gear member of the second planetary gear set may be a ring gear. Accordingly, the third gear members of the respective first and second gear sets may be characterized by the same tooth count.

The starter may be configured to be operated by a 12-volt electrical system, and be included in a motor vehicle for starting the engine.

The above features and advantages and other features and advantages of the present invention are readily apparent from the following detailed description of the best modes for carrying out the invention when taken in connection with the accompanying drawings.

DETAILED DESCRIPTION

Figure 1:
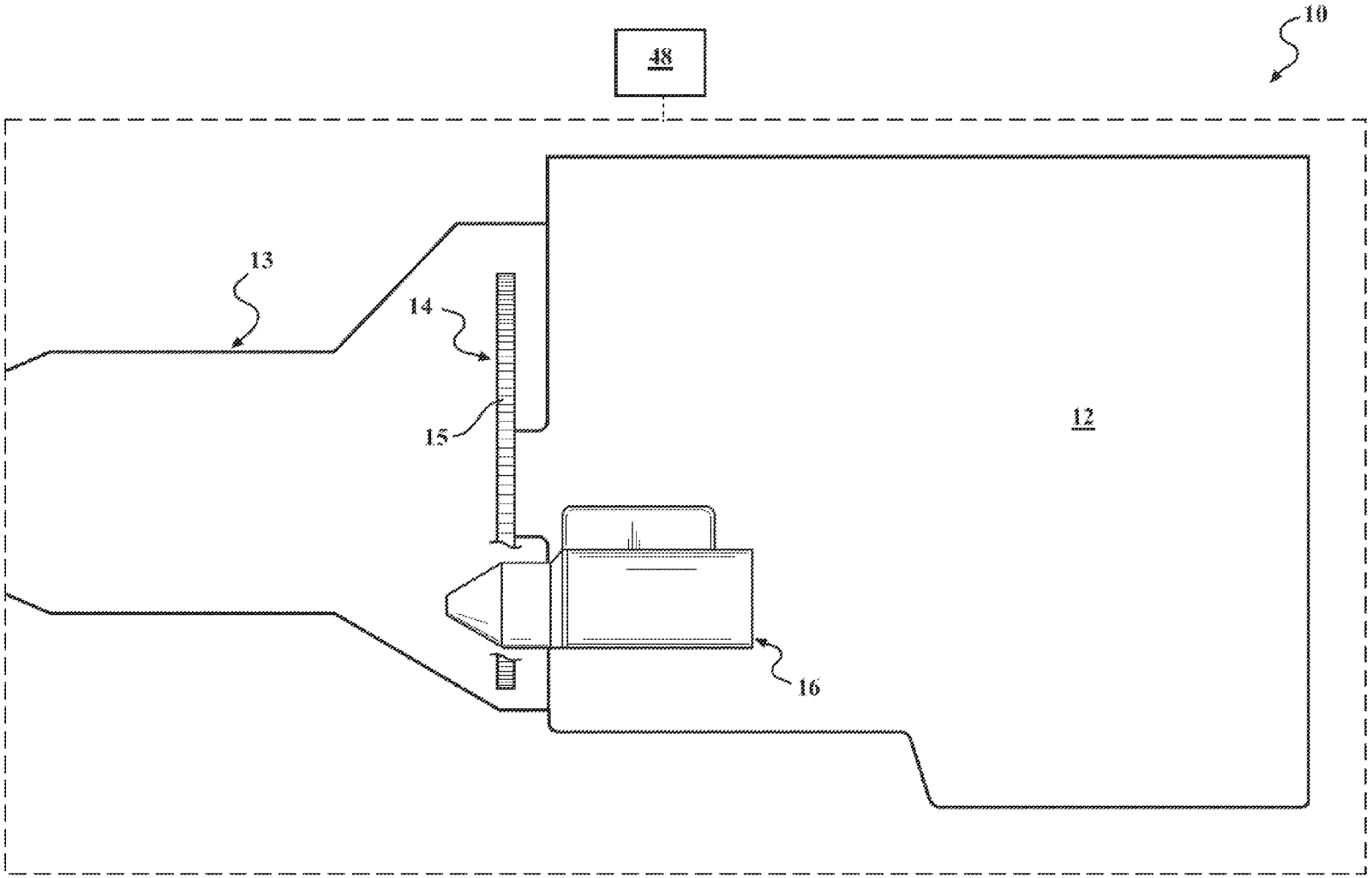
FIG. 1 is a schematic illustration of a motor vehicle powertrain including an engine having a stop-start capability and a multiple gear ratio starter for starting the engine.

Referring to the drawings, wherein like reference numbers refer to like components, FIG. 1 shows a schematic view of a motor vehicle 10 which includes an engine 12 equipped with a stop-start capability. The engine 12 is operatively connected to a transmission 13. The engine 12 may be employed as part of a conventional powertrain, where the engine is configured as the vehicle's prime mover. The engine 12 may also be employed as part of a hybrid-electric type vehicle powertrain, where the engine is operated as part of a system with one or more motor/generator (not shown) for powering the vehicle.

The engine 12 includes a flex-plate or a flywheel 14 attached to a crankshaft (not shown) of the engine, and, as such, rotates at the same speed as the engine. The flywheel 14 is typically attached to the crankshaft via fasteners such as bolts or screws (not shown). A ring gear 15 having a specific gear tooth profile and spacing is arranged on the outer perimeter of flywheel 14. The ring gear 15 typically has an outer diameter that is designed to facilitate effective starting of the engine 12, as understood by those skilled in the art.

A starter 16 is arranged relative to the engine 12 in close proximity to the ring gear 15 for starting the engine. The starter 16 may be mounted directly on engine 12 to reduce the effect of manufacturing tolerances, as shown in FIG. 1. A schematic diagram of the starter 16 is shown in detail in FIG. 2. The starter 16 includes a stationary member, which is shown as a housing 18. The housing 18 accommodates the internal workings of starter 16. Starter 16 includes an electric motor 20 that is employed to rotate a center shaft 22.

Typically, the starter 16 also includes a pinion engagement solenoid assembly (not shown), which commonly incorporates a motor solenoid and a pinion-shift solenoid. Motor 20 is activated by a motor solenoid (not shown) via an electrical connection or via a suitable lever arrangement in order to rotate the center shaft 22. The motor solenoid receives electrical power from an energy storage device such as a battery (not shown) that is located on-board the host vehicle to thereby activate the motor 20. Pinion-shift solenoid is configured to energize a lever arrangement (not shown). When energized by the pinion-shift solenoid, a lever arrangement in turn displaces the pinion gear 42 for meshed engagement with the ring gear 15, in order to start the engine 12.

The motor 20 is operatively connected to each of a first planetary gear set 24 and a second planetary gear set 32. The first planetary gear set 24 includes a first gear member 26 which is shown as a sun gear, a second gear member 28 which is shown as a planetary carrier, and a third gear member 30 which is shown as a ring gear. The third gear member 30, configured as a ring gear, rotatably circumscribes the first gear member 26. The second gear member 28, configured as a planetary carrier, rotatably supports a plurality of pinion gears that meshingly engage both the first gear member 26 and the third gear member 30. The second planetary gear set 32 includes a first gear member 34 which is shown as a sun gear, a second gear member 36 which is shown as a planetary carrier, and a third gear member 38 which is shown as a ring gear. The third gear member 38, configured as a ring gear, rotatably circumscribes the first gear member 34. Similar to the construction of the first planetary gear set 24, the second gear member 36, configured as a planetary carrier, rotatably supports a plurality of pinion gears that meshingly engage both the first gear member 34 and the third gear member 38. Each of the respective first and second planetary gear sets is operatively connected to an output member 40 which may be a rotatable shaft. The output member 40 is connected to a drive pinion gear 42 for unitary rotation therewith, wherein the pinion gear is configured to be shifted into meshed contact with the ring gear 15 for starting the engine 12 by driving the flywheel 14. Accordingly, the pinion gear 42 includes a gear tooth profile and spacing that corresponds to that of the ring gear 15 for accurate meshing and engagement therewith.

Figure 2:
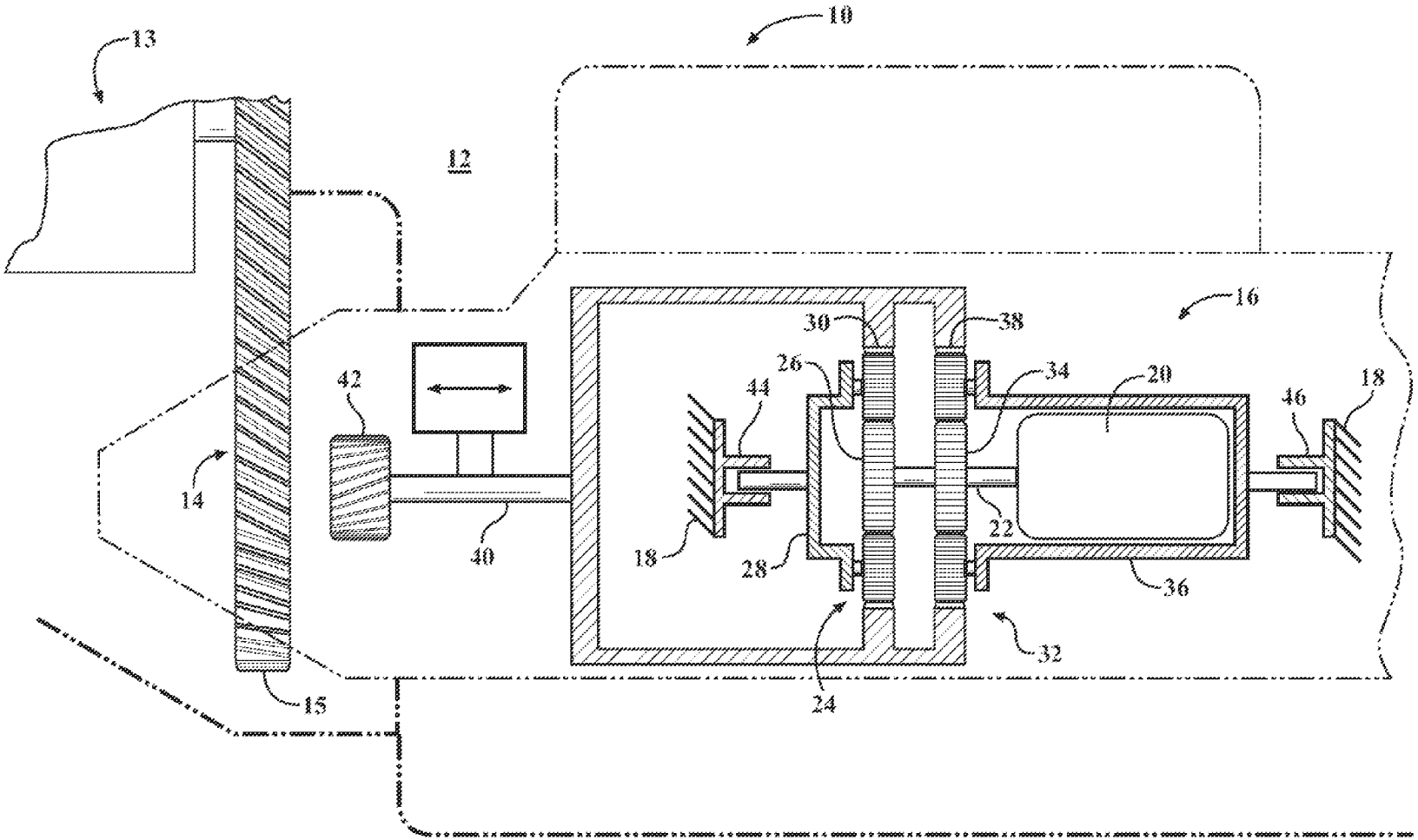
FIG. 2 is a schematic diagram of the starter depicted in FIG. 1.

As shown in FIG. 2, the third gear member 30 of the first planetary gear set 24 and the third gear member 38 of the second planetary gear set 32 are each operatively connected to the output member 40. Moreover, the third gear member 30 may be continuously connected for synchronous rotation with the third gear member 38. Such synchronous rotation of the third gear member 30 with the third gear member 38 may be provided by welding the two third gear members together or connecting them by an interlocking arrangement. As may additionally be seen from FIG. 2, the motor 20 is operatively connected to the first gear member 26 of the first planetary gear set 28 and also to the first gear member 34 of the second planetary gear set 32. Such connection of the motor 20 to the first gear member 26 and to the first gear member 34 may be accomplished via a common center shaft 22, or by having a separate shaft located along a common axis with the center shaft and continuously connected for common rotation therewith.

The starter 16 includes a first torque-transmitting device 44 and a second torque-transmitting device 46 (shown in FIG. 2). The first torque-transmitting device 44 is engageable to ground the second gear member 28 to the housing 18, while the second torque-transmitting device 46 is engageable to ground the second gear member 36 to the housing 18. The first torque-transmitting device 44 and the second torque-transmitting device 46 may be one of a selectively engageable clutch and a selectively engageable brake. Although not explicitly shown, each of the first and second torque-transmitting devices 44, 46 may be selectively engaged either by mechanical actuation, such as via a lever arrangement, electromechanical actuation, such as via a solenoid, or via a hydraulic pressure.

The first gear members 26 and 34 of the respective first and second gear sets 24 and 32 may be characterized by a different tooth count. Additionally, the third gear members 30 and 38 of the respective first and second gear sets may be characterized by the same tooth count. Such an arrangement of gears is intended to permit at least two distinct gear ratios between the center shaft 22 and the output shaft 40 by the actuation of the first and second torque-transmitting devices 44 and 46. As envisioned, engaging the first torque-transmitting device 44 and disengaging the second torque-transmitting device 46 transfers torque from the motor 20 to the output shaft 40, and thereby provides a first engine starting mode. Additionally, engaging the second torque-transmitting device 46 and disengaging the first torque-transmitting device 44 also transfers torque from the motor to the output shaft, but provides a second engine starting mode. The first and second engine starting modes each provide a distinct gear ratio between the center shaft 22 and the output shaft 40. Accordingly, the first engine starting mode may be a numerically lower gear ratio between the center shaft 22 and the output shaft 40 as compared with a gear ratio provided by the second engine starting mode, or vice versa.

The provision of at least two distinct gear ratios by starter 16 permits the starter to engage the ring gear 15 and selectively crank the engine 12 to two distinct speeds prior to initiating combustion inside the engine. Additionally, such capability to select distinct gear ratios results in improved durability of the starter 16, as well as reduced noise, vibration, and harshness (NVH) during the starting of the engine 12. Therefore, the starter 16 is particularly useful for re-starting the engine 12 when, following engine shut-off, the speed of the engine did not, for whatever reason, decrease to zero revolutions per minute (RPM). The starter 16 may be employed in any vehicle having an engine, but is particularly beneficial in a vehicle where the engine 12 has a stop-start feature. As is known by those skilled in the art, a stop-start feature in an engine is where the engine is capable of being shut off when engine power is not required, but which may also be immediately restarted when engine power is again called upon to power the vehicle. The starter 16 may be sized to operate within the framework of a standard for the automotive industry 12-volt electric system, thereby offering an efficient, i.e., low cost and weight, stop-start system for the engine 12.

Figure 3:
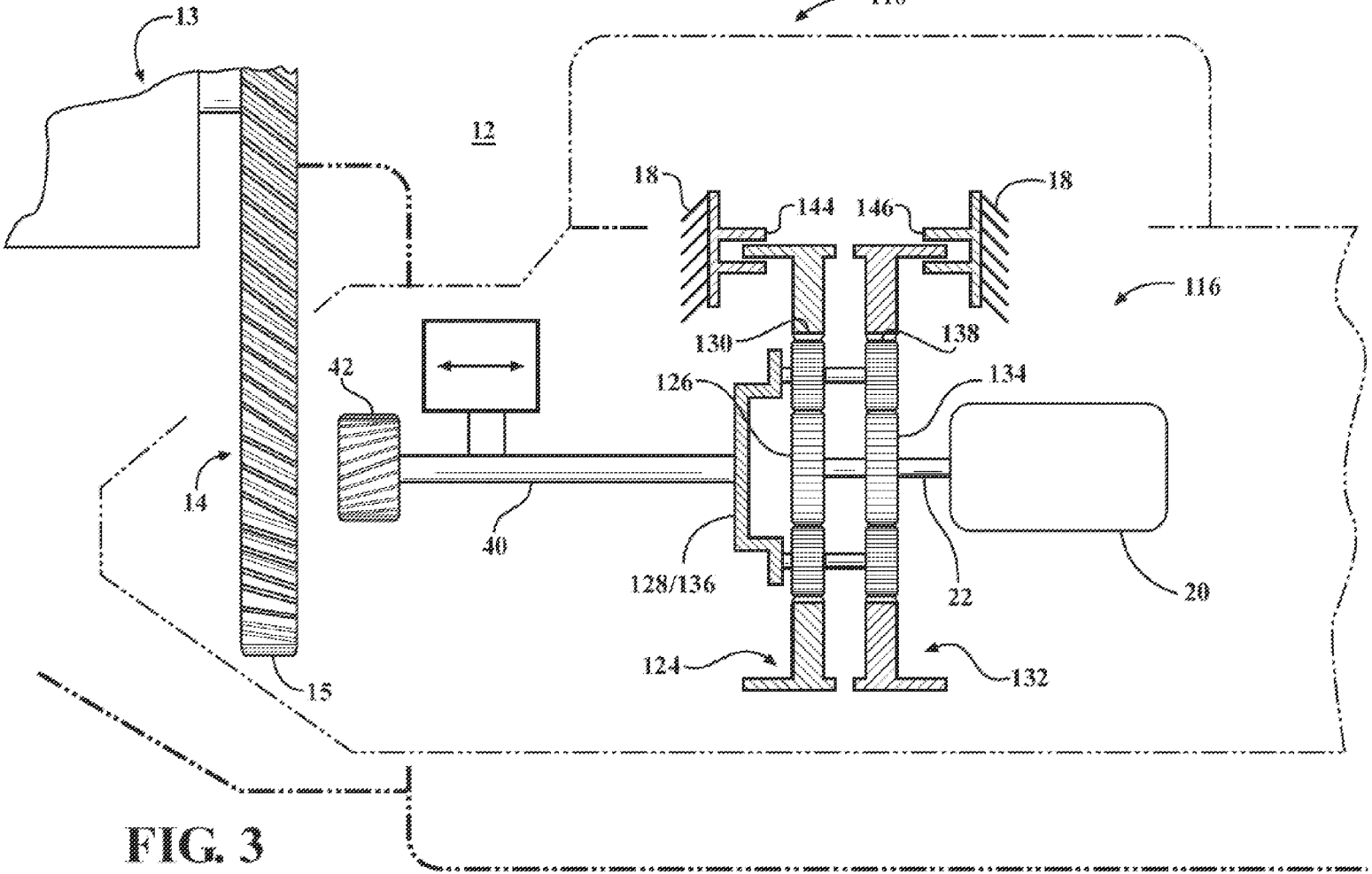
FIG. 3 is a schematic diagram of an alternative embodiment of the starter depicted in FIG. 1.

A vehicle 110 is shown in FIG. 3. The vehicle 110 is an alternative embodiment of vehicle 10 described above with respect to FIG. 1. The vehicle 110 includes a starter 116 that is generally similar to starter 16 shown in FIG. 2. The starter 116 includes a first planetary gear set 124 that is generally similar in construction to the first planetary gear set 24, and a second planetary gear set 132 that is similar in construction to the second planetary gear set 24. According to the alternative embodiment, the first planetary gear set 124 includes a first gear member 126 which is shown as a sun gear, a second gear member 128 which is shown as a planetary carrier, and a third gear member 130 which is shown as a ring gear. The second planetary gear set 132 includes a first gear member 134 which is shown as a sun gear, a second gear member 136 which is shown as a planetary carrier, and a third gear member 138 which is shown as a ring gear. The second gear member 128 is continuously connected to the second gear member 136, and, in fact, may exhibit a unitary construction or a common planetary carrier that is identified as 128/136 in FIG. 3. The common planetary carrier 128/136 is operatively connected to the output shaft 40

As shown in FIG. 3, the starter 116 includes a first torque-transmitting device 144 and a second torque-transmitting device 146. The first torque-transmitting device 144 is engageable to ground the third gear member 130 to the housing 18, while the second torque-transmitting device 146 is engageable to ground the third gear member 138 to the housing 18. Similar to the first and second torque-transmitting devices 44 and 46, the first torque-transmitting device 144 and the second torque-transmitting device 146 may be one of a selectively engageable clutch and a selectively engageable brake. Other than the differences outlined above, the starter 116 may be characterized by construction that is identical to that of the starter 16 shown in FIG. 2.

Referring back to FIG. 1, a controller 48 may be arranged on the vehicle 10 relative to the engine 12 and to the starter 16. The controller 48 may be configured to control operation of both the engine 12 and the starter 16, including the shutting down and re-starting of the engine during the stop-start procedure. The controller 48 is programmed to activate the starter 16 on demand to start the engine 12 in either the first engine starting mode, by engaging the first torque-transmitting device 44 and disengaging the second torque-transmitting device 46, or in the second engine starting mode, by engaging the second torque-transmitting device 46 and disengaging the first torque-transmitting device 44, based on predetermined vehicle operating parameters. Vehicle operating parameters may be predetermined empirically during calibration and testing phases of vehicle development, with the aim of optimizing performance, drivability and efficiency of the subject vehicle.

Overall, each of the starters 16 and 116 enable a selection of a fixed gear ratio to provide two distinct cranking speeds during engine starting events. Such capability to choose between two distinct cranking speeds helps reduce NVH concerns during the starting of the engine 12, and allows the engine to be started efficiently under cold or hot ambient conditions. Additionally, the capability to choose between two distinct cranking speeds may decrease engine start times, which may be particularly beneficial for vehicle applications having engines equipped with a stop-start capability.

While the best modes for carrying out the invention have been described in detail, those familiar with the art to which this invention relates will recognize various alternative designs and embodiments for practicing the invention within the scope of the appended claims.

The invention claimed is:

1. A starter for an internal combustion engine, the starter comprising:

a stationary member;

an output member adapted for starting the engine;

a first planetary gear set and a second planetary gear set, wherein each of the respective first and second planetary gear sets includes a first, a second, and a third gear member, and each of the respective first and second planetary gear sets is operatively connected to the output member, and wherein one of the first, second, and third gear members of each of the first planetary gear set and the second planetary gear set is a ring gear; and a motor operatively connected to the first gear set and to the second gear set for driving the output member;

wherein the third gear member of the first planetary gear set and the third gear member of the second planetary gear set are each operatively connected to the output member.

2. The starter of claim 1, wherein the third gear member of the first planetary gear set is attached for synchronous rotation with the third gear member of the second planetary gear set.

3. The starter of claim 1, further comprising a first torque-transmitting device and a second torque-transmitting device, wherein the first torque-transmitting device is engageable to ground one of the second gear member and the third gear member of the first planetary gear set to the stationary member, and wherein the second torque-transmitting device is engageable to ground one of the second gear member and third gear member of the second planetary gear set to the stationary member.

4. The starter of claim 3, wherein any of the first torque-transmitting device and the second torque-transmitting device is one of a selectively engageable clutch and a selectively engageable brake.

5. The starter of claim 3, wherein:

engaging the first torque-transmitting device and disengaging the second torque-transmitting device transfers torque from the motor to the output shaft and provides a first engine starting mode; and engaging the second torque-transmitting device and disengaging the first torque-transmitting device transfers torque from the motor to the output shaft and provides a second engine starting mode.

6. The starter of claim 1, wherein the motor is operatively connected to the first gear member of the first planetary gear set and to the first gear member of the second planetary gear set.

7. The starter of claim 6, wherein the motor is operatively connected to the first gear member of the first planetary gear set and to the first gear member of the second planetary gear set via a common shaft.

8. The starter of claim 1, wherein:

each of the first gear member of the first planetary gear set and the first gear member of the second planetary gear set is a sun gear, and the first gear members of the respective first and second gear sets are characterized by a different tooth count; and each of the third gear member of the first planetary gear set and the third gear member of the second planetary gear set is the respective ring gear, and the third gear members of the respective first and second gear sets are characterized by the same tooth count.

9. The starter of claim 1, wherein the starter is configured to be operated by a 12-volt electrical system.

10. A motor vehicle comprising:

an internal combustion engine having a stop-start capability; and a starter including:

a stationary member;

an output member adapted for starting the engine;

a first planetary gear set and a second planetary gear set, wherein each of the respective first and second planetary gear sets includes a first, a second, and a third gear member, and each of the respective first and second planetary gear sets is operatively connected to the output member, and wherein one of the first, second, and third gear members of each of the first planetary gear set and the second planetary gear set is a ring gear; and a motor operatively connected to the first gear set and to the second gear set for driving the output member wherein the third gear member of the first planetary gear set and the third gear member of the second planetary gear set are each operatively connected to the output member.

11. The vehicle of claim 10, wherein the third gear member of the first planetary gear set is attached for synchronous rotation with the third gear member of the second planetary gear set.

12. The vehicle of claim 10, further comprising a first torque-transmitting device and a second torque-transmitting device, wherein the first torque-transmitting device is engageable to ground one of the second gear member and the third gear member of the first planetary gear set to the stationary member, and wherein the second torque-transmitting device is engageable to ground one of the second gear member and third gear member of the second planetary gear set to the stationary member.

13. The vehicle of claim 12, wherein any of the first torque-transmitting device and the second torque-transmitting device is one of a selectively engageable clutch and a selectively engageable brake.

14. The vehicle of claim 12, wherein:

engaging the first torque-transmitting device and disengaging the second torque-transmitting device transfers torque from the motor to the output shaft and provides a first engine starting mode; and engaging the second torque-transmitting device and disengaging the first torque-transmitting device transfers torque from the motor to the output shaft and provides a second engine starting mode.

15. The vehicle of claim 10, wherein the motor is operatively connected to the first gear member of the first planetary gear set and to the first gear member of the second planetary gear set.

16. The vehicle of claim 15, wherein the motor is operatively connected to the first gear member of the first planetary gear set and to the first gear member of the second planetary gear set via a common shaft.

17. The vehicle of claim 10, wherein:

each of the first gear member of the first planetary gear set and the first gear member of the second planetary gear set is a sun gear, and the first gear members of the respective first and second gear sets are characterized by a different tooth count; and each of the third gear member of the first planetary gear set and the third gear member of the second planetary gear set is the respective ring gear, and the third gear members of the respective first and second gear sets are characterized by the same tooth count.

18. The vehicle of claim 10, wherein the starter is configured to be operated by a 12-volt electrical system.

* * * * *